US009927771B2

(12) United States Patent
Marechal et al.

(10) Patent No.: US 9,927,771 B2
(45) Date of Patent: Mar. 27, 2018

(54) SELF-WINDING MECHANISM FOR WATCHES

(71) Applicant: The Swatch Group Research and Development Ltd, Marin (CH)

(72) Inventors: Sylvain Marechal, Bois-d'Amont (FR); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/293,718

(22) Filed: Oct. 14, 2016

(65) Prior Publication Data

US 2017/0115628 A1 Apr. 27, 2017

(30) Foreign Application Priority Data

Oct. 26, 2015 (EP) ..... 15191497

(51) Int. Cl.
*G04B 5/02* (2006.01)
*G04B 5/04* (2006.01)
(Continued)

(52) U.S. Cl.
CPC ..... *G04B 5/04* (2013.01); *G04B 3/00* (2013.01); *G04B 3/02* (2013.01); *G04B 5/005* (2013.01);
(Continued)

(58) Field of Classification Search
CPC . G04B 5/04; G04B 3/00; G04B 5/005; G04B 3/02; G04B 5/02; G04B 5/20;
(Continued)

(56) References Cited

U.S. PATENT DOCUMENTS 2,577,679 A 12/1951 Fraser
3,695,035 A * 10/1972 Cleusix ..... G04B 27/001 368/191
(Continued)

FOREIGN PATENT DOCUMENTS

CH 705 938 A1 6/2013
WO WO 2009/044027 A2 4/2009

OTHER PUBLICATIONS

European Search Report dated Apr. 20, 2016 in European Application 15191497.5 filed on Oct. 26, 2015 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

Watch comprising a case containing an energy accumulator recharged by a winding mechanism, this watch is arranged to receive, attached to the case or in immediate proximity thereto, an additional self-winding mechanism arranged to be worn by a user at the same time as the watch and comprising a transmitter wheel set arranged for contactless cooperation with a receiver wheel set comprised in the winding mechanism, by remote interaction under the action of a field in the air-gap between the transmitter wheel set and the receiver wheel set, the intensity of the field and the maximum air-gap distance being defined to transmit to the receiver wheel set, to recharge the energy accumulator, a torque or a force imparted by a user to the transmitter wheel set, and the additional self-winding mechanism is removable and portable with respect to the case.

22 Claims, 5 Drawing Sheets

(51) Int. Cl.

| | |
|---|---|
| ***G04B 3/00*** | (2006.01) |
| ***G04B 5/00*** | (2006.01) |
| ***G04B 3/02*** | (2006.01) |
| ***G04B 5/20*** | (2006.01) |
| ***G04B 7/00*** | (2006.01) |
| ***G04B 37/12*** | (2006.01) |

(52) U.S. Cl.
CPC ..... *G04B 5/02* (2013.01); *G04B 5/20* (2013.01); *G04B 7/00* (2013.01); *G04B 37/12* (2013.01)

(58) Field of Classification Search
CPC . G04B 7/00; G04B 37/12; G04B 5/06; G04B 5/08; G04B 5/10; G04B 5/14; G04B 5/16; G04B 5/165
USPC ..... 368/148
See application file for complete search history.

(56) References Cited

U.S. PATENT DOCUMENTS

| | | | | |
|---|---|---|---|---|
| 3,747,328 | A * | 7/1973 | Winkler | G04F 3/022 368/214 |
| 5,278,806 | A * | 1/1994 | Affolter | G04C 10/00 368/179 |
| 5,844,863 | A * | 12/1998 | Voss | G04B 19/02 368/223 |
| 2006/0109748 | A1* | 5/2006 | Della Santa | G04B 3/02 368/203 |
| 2007/0159929 | A1* | 7/2007 | Louie | G04B 3/006 368/206 |
| 2010/0302911 | A1 | 12/2010 | Andre et al. | |

* cited by examiner

SELF-WINDING MECHANISM FOR WATCHES

This application claims priority from European Patent Application No 15191497.5 of Oct. 26, 2015 the entire disclosure of which is hereby incorporated herein by reference.

FIELD OF THE INVENTION

The invention concerns a watch comprising a case containing a movement and at least one energy accumulator recharged with energy by at least one winding mechanism.

The invention concerns the field of mechanical or electronic watches comprising energy charging means that convert deliberate or unintentional movements made by the user.

BACKGROUND OF THE INVENTION

Mechanical watches are often divided into two categories: those in which winding is performed manually, and those having an oscillating weight for automatic winding.

Although the watches in the second category are presented as being more technologically advanced, manual watches still have many advantages today: greater compactness, silent operation since there is no noise from bearings, no feeling of unbalance on the wrist, the movement is entirely visible from the back side of the case, and there is less wear on the barrel Moreover, some users are attached to the ritual of manually winding their watch.

Some users therefore have to make a sometimes difficult choice between the practical aspects of an automatic watch and the traditional and emotional advantages of manual winding. There is no watch on the market that allows users to choose between either one system or the other.

The oscillating weights of a self-winding mechanism also occupy a large volume inside the case, which can therefore contain only a limited number of complications. This is why watches with large complications are rarely self-winding watches.

WO Patent Application 2009/044027 A2 in the name of CELSIUS describes a mobile telephone, comprising a mechanical wind watch, wherein a mechanical winding device, which can be uncoupled in the closed position, spares the user from manual winding by making use of kinetic energy, in particular the opening of the main flag or a battery hatch, the sliding of a screen, access to a specific function by pivoting or sliding the watch, or even simply moving the mobile telephone, via a mechanism housed inside a hinge or in a slide-way. This telephone combined with a watch is in one-piece or hinged.

U.S. Pat. No. 2,577,679 A in the name of FRASER FRANK describes the disconnectable combination of the lighter wheel of a lighter with the winding mechanism of a watch carried by the lighter case, to which these mechanisms are connected.

CH Patent Application 705938 A1 in the name of ULYSSE NARDIN describes a timepiece comprising a planetary gear train for transferring energy from the input of the planetary gear train to the output of the planetary gear train, comprising a planetary train with two planet wheels, with an arm carrying one or two sun wheels each cooperating with a wheel or crown centred on the axis of rotation of the arm. This mechanism may also ensure the disengagement of the manual winding mechanism.

WO Patent Application 2014/166719 in the name of The Swatch Group RESEARCH & Ltd DEVELOPMENT describes a static device of winding of automatic watches, comprising a means of power supply or an electricity storage device, and a support comprising a support surface intended to receive in abutment the bottom of a watch. This device comprises means of generation of an electrostatic or/and magnetic field laid out in fixed position under the support surface and generating, on the level of an angular sector of an annular zone of emission, a magnetic or electrostatic field having a direction orthogonal to the support surface, and having a variable intensity or/and direction in function of the time. It describes also a watch comprising an automatic winder with an oscillating mass comprising a first ferromagnetic internal part and a peripheral second part in heavy metal, or a paramagnetic conducting disc coaxial with the oscillating mass.

CH Patent Application 706,352 A2 in the name of WATCHES BREGUET SA describes a watch comprising, in a tight case, a mobile component for driving a static winding mechanism of a static, free according to at least a degree of freedom and comprising at least a mobile receiving surface near an end surface of the case. This receiving surface comprises a magnetically permeable, or magnetic polar mass, for its driving by coupling under the effect of at least a magnetic field applied in the vicinity of this end surface and outside the case. The direction of this field is mobile in relation to the surface of end.

FR Patent Application 1,546,744 A in the name of MOUTSCHEN describes an automatic watch, which comprises a particular device of automatic winding, with removal of a traditional mechanical winder and of a traditional setting gear train. The adjustment of this watch, in particular of the index, is possible by magnetic influence through the case, like the driving of a winding reverser. This document quotes, without detailing it, a mechanic-magnetic winding, by a magnetic serrated roller external to the case, which requires a voluntary manual movement of the user for driving in rotation, this movement similar to that applied to a serrated roller of a lighter, which probably requires the removal of the watch. It is thus about only a manual winding mechanism which is different from the known systems.

WO Patent Application 02/44818 in the name of TAG HEUER describes a watch case comprising a middle, and a rotating bezel outside this middle. The rotating bezel comprises a magnetic portion, and a body inside the middle is laid out so as to be able to be driven by the magnetic field of the magnetic portion. This body comprises a ring concentric with the aforementioned rotating bezel and with a magnetic portion, so as to be able to be involved in rotation by the magnetic field of the rotating bezel during its rotation, and in which this body is of analogical type and can take an infinity of distinct positions according to the angular position of the rotating bezel. This device is not removable.

SUMMARY OF THE INVENTION

The invention proposes to provide a solution to transform a manual wind mechanical watch into an automatic wind mechanical watch, or to transform an existing automatic wind watch into a manual wind watch, compatible with an additional unit that can perform automatic winding. This additional unit is devised to be worn with the watch, by the user, and its dimensions and mass must be very limited, in order to ensure it is comfortable for the user to wear.

An optional module comprising at least one oscillating weight can be added to the watch case by the user, without affecting the impermeability of the combined assembly.

To this end, the invention concerns a watch according to claim 1.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
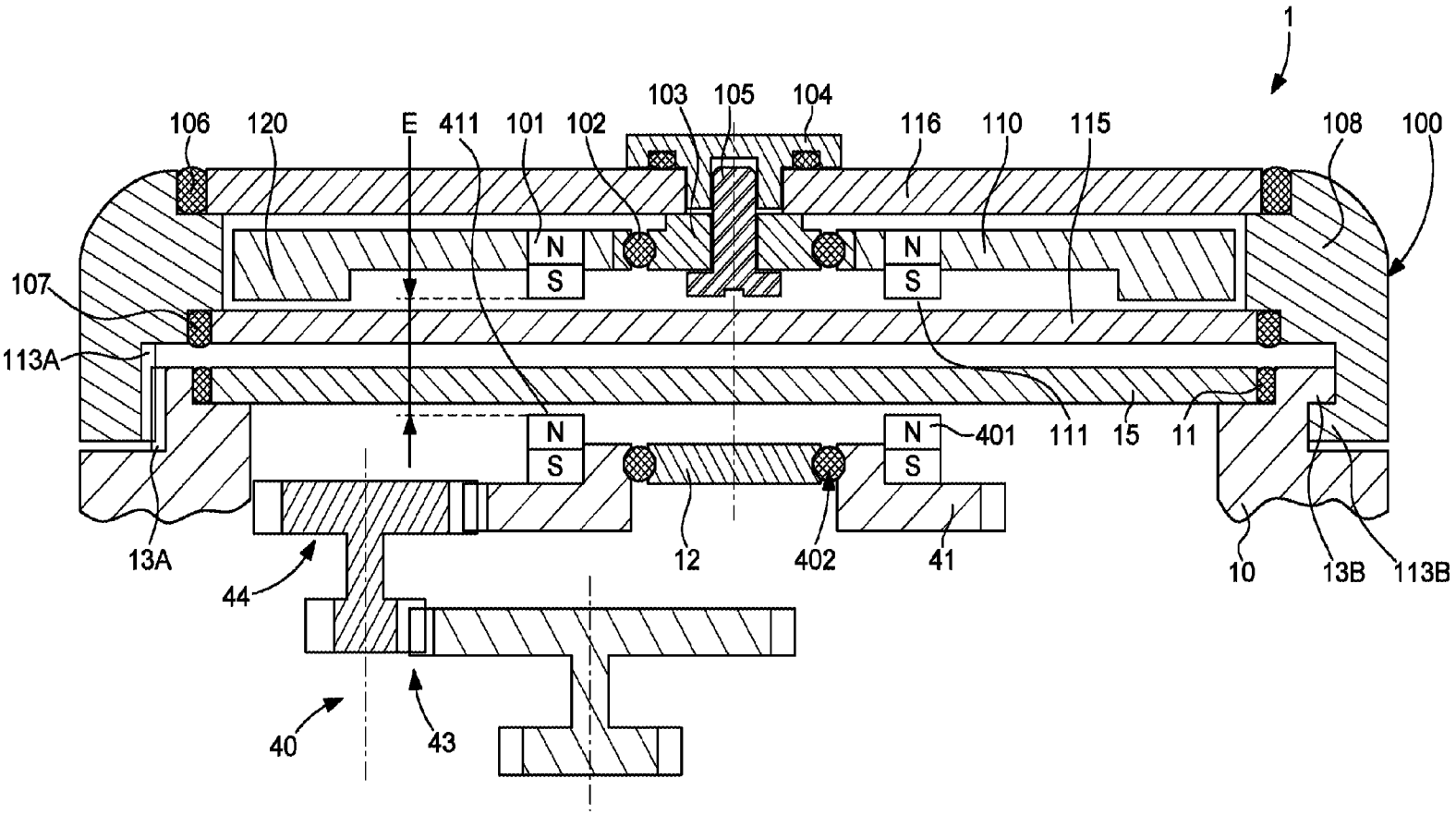
FIG. 1 shows a partial schematic view, in substantially median cross-section, of a watch according to the invention, comprising a portable, removable, additional self-winding mechanism unit, containing an oscillating weight carrying a transmitter wheel set which is magnetically coupled to a receiver wheel set contained inside the watch case and kinematically connected, by a gear train (not shown in detail) and comprising at least one means for disengaging, in the event of excessive torque, from a winding mechanism; two different assembly variants between the case and the additional unit are illustrated to the right and to the left of this Figure.

The invention proposes to create an additional self-winding module, which is portable, removable and can be very easily fitted or removed by the user himself. The invention concerns all watches comprising a manual wind mechanism, capable of storing mechanical energy or of converting mechanical energy to electrical energy. In particular, the invention can very easily be applied to watches comprising a conventional winding mechanism, using a stem operated by a crown.

According to the invention, the transformation of a manual wind watch into an automatic wind watch is achieved simply: by adding to the watch case, on the case back, the bezel or periphery thereof, an optional module containing at least one oscillating weight.

Preferably, the coupling system between a reduction gear of the optional module and a reduction gear of the winding mechanism, or of the movement, inside the watch case is achieved in a contactless manner, as shown schematically in FIGS. 3 to 7.

Thus, the invention concerns a watch 1 comprising a case 10 containing a movement 20, and at least one energy accumulator 30, which is recharged with energy by at least one winding mechanism 40.

According to the invention, watch 1 is arranged to receive, attached to case 10 or to a bracelet 50 or to an external component 60 of watch 1 disposed in immediate proximity to case 10, at least one additional self-winding mechanism 100, which is arranged to be worn by a user at the same time as watch 1.

In an advantageous variant of the invention, this additional self-winding mechanism 100 comprises at least one transmitter wheel set 110, which is arranged to cooperate in a contactless manner with at least one receiver wheel set 41 comprised in such a winding mechanism 40, by remote interaction. This remote interaction is achieved under the action of at least one field, in the air gap E between the at least one transmitter wheel set 110 and the at least one receiver wheel set 41. The intensity of this at least one field, and the maximum distance of air-gap E, are defined to allow the transmission, to at least one receiver wheel set 41, of a torque or a force imparted by any movement of a user to at least one transmitter wheel set 110, in order to recharge with energy at least one energy accumulator 30.

This torque or force may result from a deliberate movement by the user, such as the operation of a bezel, of a push-piece or other element, or from an unintentional movement, made use of in self-winding mechanisms with an oscillating weight, which are well known to those skilled in the art.

Watch 1 may comprise several such additional self-winding mechanisms 100.

According to the invention, at least one of these additional self-winding mechanisms 100 is removable and portable with respect to case 10. "Portable" means that the mass of additional mechanism 100 is less than that of case 10 fitted with movement(s) 20, energy accumulator(s) 30 and winding mechanism(s) 40.

In a first variant of the invention, watch 1 is a mechanical or electronic watch with a mechanical or electronic movement 20 and with at least one energy accumulator 30 that comprises at least one mainspring barrel 31.

In another variant of the invention, watch 1 is an electronic watch with an electronic or electromechanical movement 20 and with at least one energy accumulator 30 powered by a mechanical-to-electrical energy converter.

In another variant of the invention, watch 1 is an electronic watch with a mechanical or electronic movement 20 and with at least one energy accumulator 30 that comprises at least one mainspring barrel 31.

The field allowing remote interaction between a transmitter wheel set 110 and a receiver wheel set 41 is preferably at a magnetic field or an electrostatic field.

In the particular, non-limiting embodiments illustrated by the Figures, watch 1 comprises at least one pair formed of one such transmitter wheel set 110 and one such receiver wheel set 41, at least one of which is magnetically charged. Transmitter wheel set 110 is magnetically charged or ferromagnetic and arranged to cooperate by magnetic interaction with receiver wheel set 41, which is ferromagnetic or magnetically charged.

More specifically, in at least one such pair, both transmitter wheel set 110 and receiver wheel set 41 are magnetically charged, as seen in FIGS. 1, 2, 9 and 10, where transmitter wheel set 110 comprises at least one transmitter pole piece 101, and where receiver wheel set 41 comprises at least one receiver pole piece 401.

The pivot arrangements of these wheels are not explained in detail, FIG. 1 shows pivoting via ball bearings 102, 402, of transmitter wheel set 110 with respect to a core 103 attached by a screw 105 to a flange 104, and of receiver wheel set 41 with respect to a core 12 attached to case 10.

Figure 2:
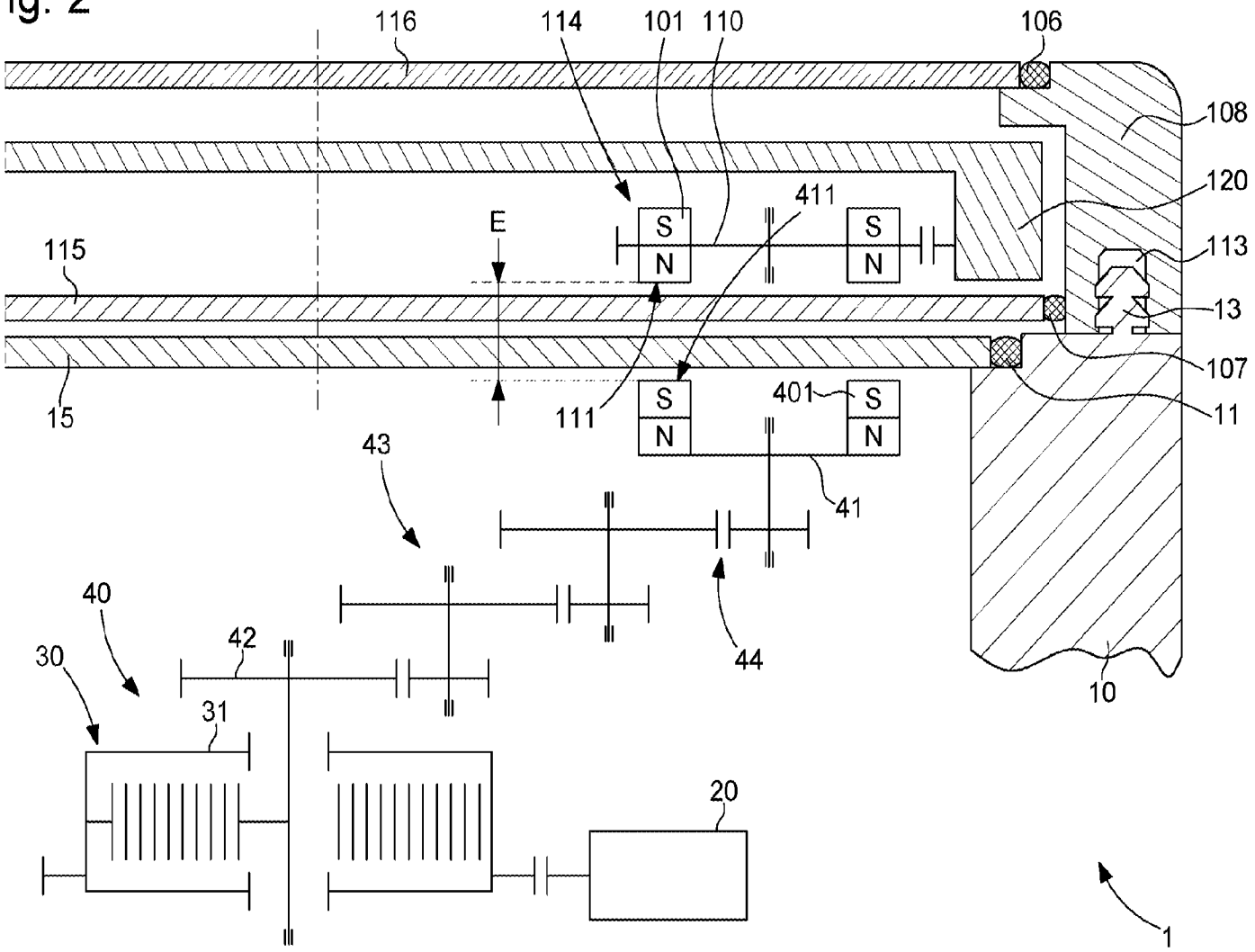
FIG. 2 represents, in a similar manner to FIG. 1, another watch also comprising a portable and removable, additional self-winding mechanism unit, which contains an oscillating weight that drives in rotation a transmitter wheel set, magnetically coupled to a receiver wheel set contained inside the watch case and kinematically connected, by a similar gear train to FIG. 1, to a winding mechanism and to an energy accumulator consisting of a conventional mainspring barrel.
Figure 5:
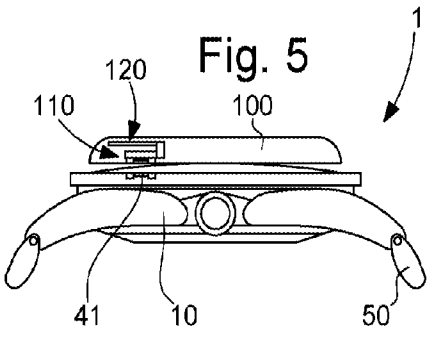
FIG. 5 represents, in a similar manner to FIGS. 3 and 4, another variant wherein the portable, removable unit containing an oscillating weight is placed on the bezel side.
Figure 4:
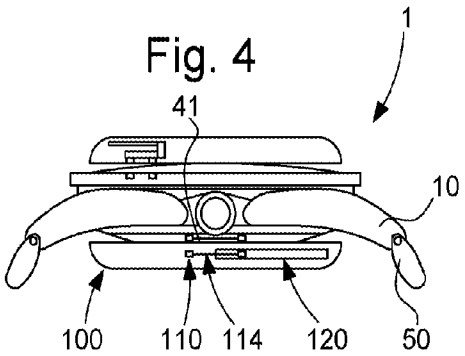
FIG. 4 represents, in a similar manner to FIG. 3, the oscillating weight meshing, as in FIG. 2, with a reduction gear which is magnetically coupled to the conventional manual wind watch case.
Figure 3:
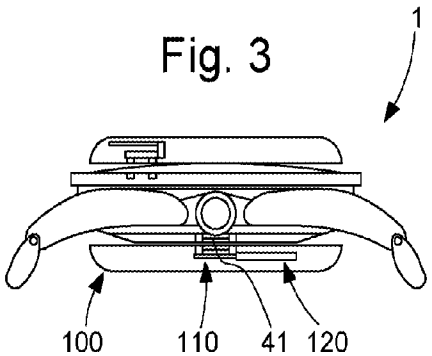
FIG. 3 shows a schematic side view of a watch according to the invention, comprising, pressed onto the back cover of the watch case, a portable and removable, additional self-winding mechanism unit, containing an oscillating weight which is magnetically coupled to a conventional manual wind watch case.
Figure 9:
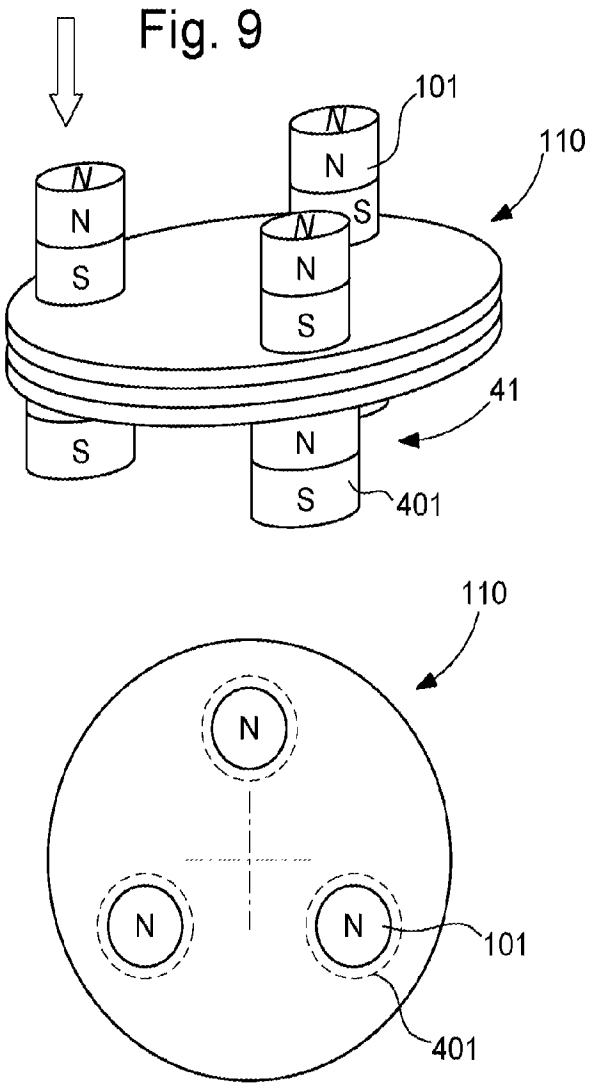
FIG. 9 shows a schematic perspective view and schematic top view along the arrow, of the cooperation between a transmitter wheel set and a receiver wheel set, which are single, coaxial wheels and each comprise three magnets with parallel axes, the transmitter wheel set magnets facing the receiver wheel set magnets being of opposite polarity thereto, and all the magnets in this case tending to be aligned in pairs.
Figure 14:
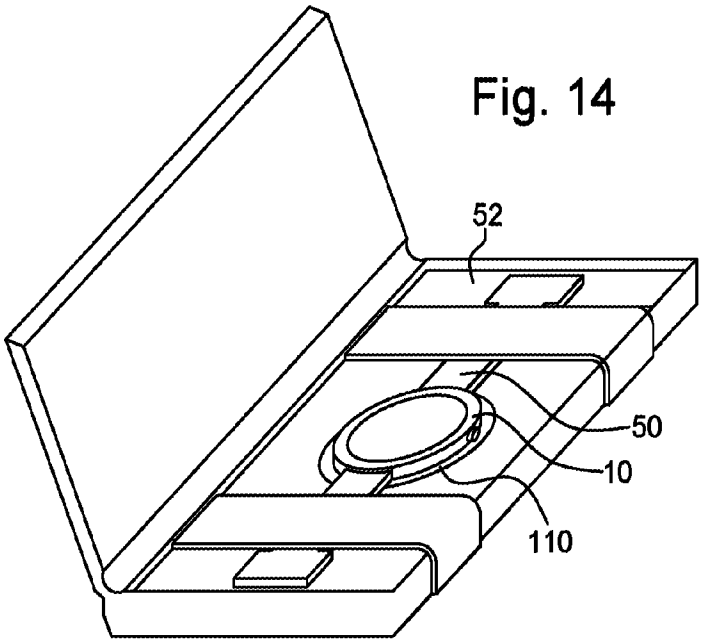
FIG. 14 shows a schematic perspective view of another accessory of the vestimentary type, here an accessory of leather goods, such as wallet, including an additional self-winding module according to the invention, and which locks up under elastic straps a unit made up of a watch case and a bracelet fixed to the case.
Figure 12:
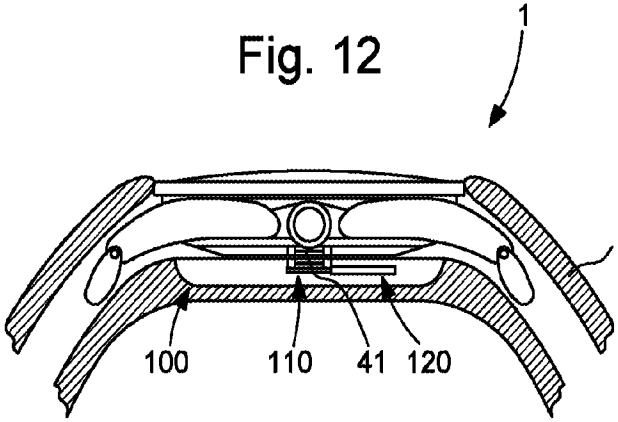
FIG. 12 represents, in a similar manner to FIG. 3, an accessory of the vestimentary type, here an additional bracelet including an additional self-winding module according to the invention, this additional bracelet locks up a unit made up of the watch case and a bracelet fixed to the case.
Figure 13:
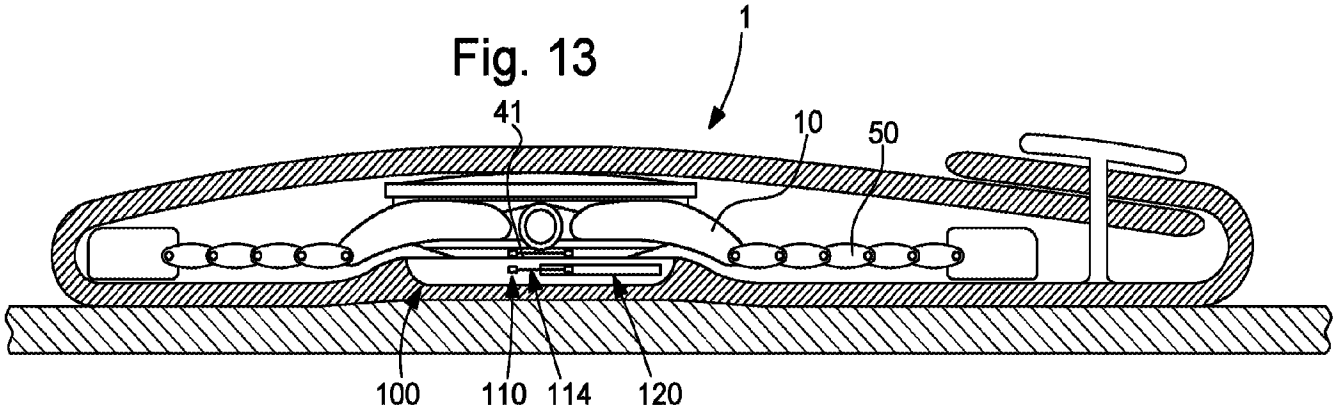
FIG. 13 represents, in a similar manner to FIG. 12, another accessory of the vestimentary type, here a clothing, in particular on the level of a pocket, including an additional self-winding module according to the invention, this clothing locks up a unit made up of the watch case and a bracelet fixed to the case.

In a first embodiment, as seen in FIGS. 1, 2 and 9, within such a pair, transmitter wheel set 110 and receiver wheel set 41 present to each other pole pieces 101 and 401, which comprise air-gap surfaces 111, respectively 411, all substantially parallel to each other and of opposite polarity. If there is an equal number and uniform distribution of pole pieces, they tend to be aligned, as visible in FIG. 9.

Figure 10:
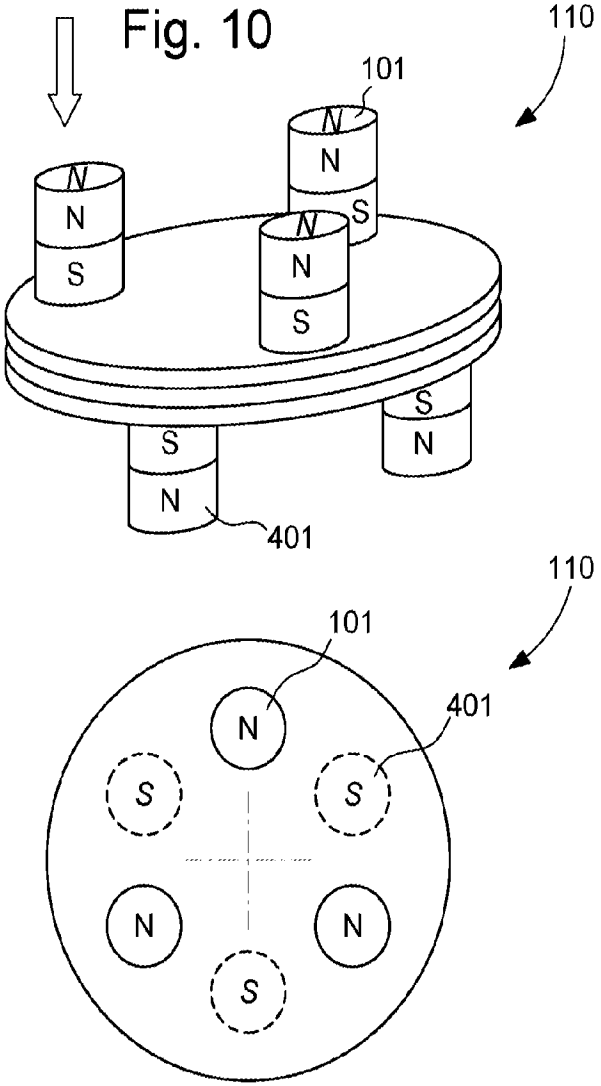
FIG. 10 represents, in a similar manner to FIG. 9, a variant wherein the transmitter wheel set magnets facing the receiver wheel set magnets are of the same polarity thereto and the magnets then tend to be in a staggered arrangement.

In another embodiment, as seen in FIG. 10, transmitter wheel set 110 and receiver wheel set 41 present to each other pole pieces 101 and 401, which comprise air-gap surfaces 111, respectively 411, all substantially parallel to each other and of the same polarity. The pole pieces tend in this case to be staggered, as seen in FIG. 10.

However, it is understood that in order to set receiver wheel set 41 in motion, it is sufficient for only one transmitter pole piece 101 to act as driver for one receiver pole piece for 11 like a drive dog. Of course, the better the coupling between transmitter pole pieces 101 and receiver pole pieces 411, the better the driving will be, regardless of whether the coupling is in an aligned arrangement as in FIG. 9, or an alternate arrangement as in FIG. 10.

In a particular embodiment, watch 1 comprises at least one pair formed of a transmitter wheel set 110 and a receiver wheel set 41; in this pair, cooperation occurs in an axial direction with respect to a main axis of case 10.

FIGS. 1, 2, 9 and 10 illustrate particular cases where the various field lines are parallel to each other, and preferably parallel to a main axis of case 10, which is the axis of movement 20 if the latter is mechanical, the main axis of the hands, or an axis of symmetry of part of the machined portions or of the bracelet fastenings via horns or suchlike. This configuration corresponds to the axial positioning examples of the additional self-winding mechanism 100, illustrated in FIGS. 3 to 7.

Figure 7:
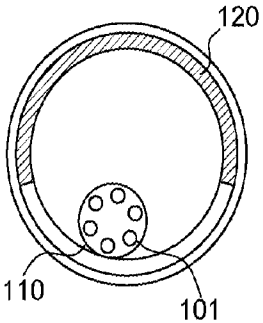
FIG. 7 shows a schematic top view of another sub-assembly consisting of an annular oscillating weight comprising an unbalance which, via an inner toothing comprised therein, drives a pivoting wheel set which is also a transmitter wheel set comprising six magnets, which are uniformly distributed around its own axis of rotation.

Other geometries are possible, notably the case where a transmitter wheel set 110 and a receiver wheel set 41 are both annular, as seen in FIG. 7.

Thus, in a particular embodiment, watch 1 comprises at least one pair formed of a transmitter wheel set 110 and a receiver wheel set 41, which are substantially annular and coaxial with respect to a main axis of case 10, in which pair cooperation occurs tangentially with respect to a cylinder or a cone whose axis of revolution is parallel to or coincides with the main axis of case 10, to enable winding to occur by a deliberate or unintentional action of the user.

Figure 8:
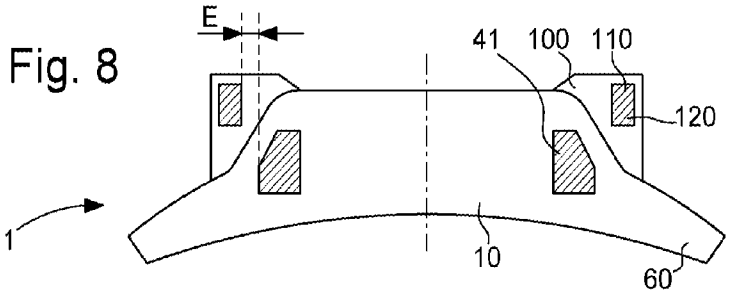
FIG. 8 shows a schematic cross-sectional view of a watch comprising a portable and removable, additional self-winding mechanism unit mounted on the bezel and cooperating with a receiver wheel set which is internal to the watch case and also annular.

FIG. 8 illustrates a particular example of such an embodiment, where the additional self-winding mechanism 100 takes the form of a bezel placed around case 10, and incorporating an annular oscillating weight 120. Advantageously, this bezel is also a magnetic driving bezel, as described in EP Patent 14185439.8 in the name of MONTRES BREGUET SA. It is then possible to dispense with the winding crown, which poses chronic difficult sealing problems, particularly for diver's watches. It is to be noted that other conventional functions, of setting the time, starting the chronograph, resetting or suchlike, can be achieved in a similar manner using contactless systems.

The user may therefore choose to wind his watch either in a conventional manner using the crown, or by rotating the bezel, or by wearing the watch.

More specifically still, the various pole pieces may be arranged radially, or tangentially, with respect to a disc or a ring which carries them. Thus, in a particular case, within such a pair, the transmitter wheel set 110 comprises transmitter pole pieces whose main field lines are coplanar in a transmitting plane, and receiver wheel set 41 comprises receiver pole pieces whose main field lines are coplanar in a receiving plane, and wherein the air-gap between transmitter wheel set 110 and receiver wheel set 41 is a cylindrical volume delimited by the transmitting plane and the receiving plane which are parallel to each other.

Many other configurations are possible; these are dictated to the designer by the space available inside case 10. One of the objects of the invention is to release, inside a mechanical watch of the type with self-winding via an oscillating weight, the large volume occupied by said weight, by moving this function outside the watch case. In positioning receiver wheel set or wheel sets 41, priority is therefore given to using spaces unsuitable for receiving complications or accessories.

Figure 6:
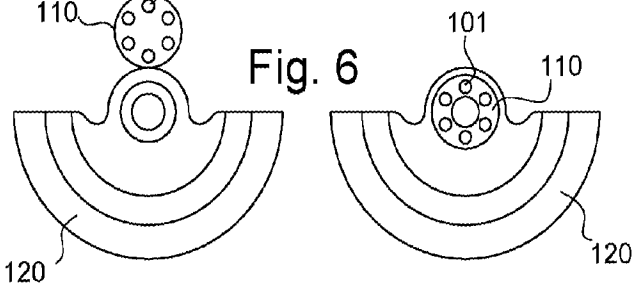
FIG. 6 shows an exploded schematic top view of the assembled position of a sub-assembly formed of a conventional oscillating weight on which is coaxially fixed a transmitter wheel set comprising six magnets uniformly distributed around the axis of rotation of the oscillating weight.
Figure 11:
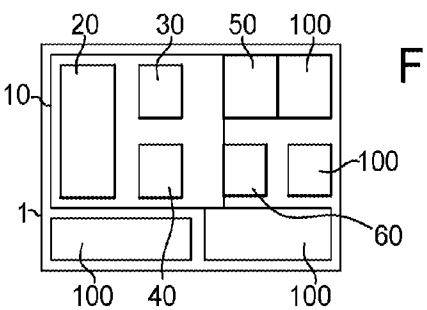
FIG. 11 represents, in the form of a block diagram, a watch comprising a case containing a movement, and an energy accumulator charged with energy by a winding mechanism, and four additional self-winding mechanism units, one of which is fixedly attached to the case, another is attached in a removable and portable manner to the case, yet another is fixedly attached to a bracelet hinged to the case, and the last is attached in a removable and portable manner to an external watch component pressed onto the case.

As seen in FIGS. 1, 2, 6, 7 and 8, additional self-winding mechanism 100 advantageously comprises at least one oscillating weight 120, which is movable under the action of movements by the user of watch 1, and which constitutes such a transmitter wheel set 110 as in FIGS. 1 and 6, or which constitutes drive means for driving the pivoting or rotation or translational motion of at least one such transmitter wheel set 110, as in FIGS. 2 and 7, where oscillating weight 120 meshes with a reduction gear 114, which constitutes transmitter wheel set 110.

Wheel set 110 includes a transmitter track 111 which is arranged to be positioned as close as possible to a receiver track 411 of such a receiver wheel set 41.

Preferably, as seen in FIG. 2, winding mechanism 40 includes, downstream of a ratchet 42 directly powering such an energy accumulator 30, a reduction train 43 which comprises, opposite ratchet 42, uncoupling means 44, using friction or other means, downstream of which is located at least one such receiver wheel set 41, in direct proximity to the inner periphery of case 10. In the variant of FIGS. 1 and 2, receiver wheel set 41 is as close as possible to a case back 15, which is advantageously transparent to allow the mechanism to be seen. Winding mechanism 40 may comprise any conventional component of a self-winding mechanism, such as reverser wheels or a click, which are well known to those skilled in the art.

In a particular variant, winding mechanism 40 comprises such a ratchet 42 directly powering an energy accumulator 30, and which constitutes a receiver wheel set 41. This solution does not seem advantageous due to the lack of a reduction gear, compared to the variant comprising a reduction train 43, but it can however be used, provided that the torque that can be transmitted by contactless interaction is sufficient to wind the barrel directly and that the energy transformed by the movement of an oscillating weight is still surplus with respect to the storage capacities of a barrel.

The invention makes it possible to free much of the inner volume of case 10, which no longer needs to be reserved for an oscillating weight, and to accommodate other functions or complications, for example in the form of additional modules. In particular, it is possible to insert a sound or musical module, comprising a striking barrel or suchlike, which can advantageously also be powered by an additional self-winding mechanism 100 according to the invention.

Consequently, it is often advantageous to let the user see the mechanisms operating inside case 10. To this end, when the additional self-winding mechanism 100 is pressed onto the back of case 10, the latter preferably has a transparent back 15, and the additional self-winding mechanism 100 comprises, on both sides of the set of transmitter wheel sets 110 comprised therein, at least two crystals 115, 116, at least one of which is arranged to be placed as close as possible to transparent case back 15, as seen in FIGS. 1 and 2. It is thus possible to display at the same time the mechanisms contained in case 10 and the content of the actual additional self-winding mechanism 100.

Case 10 comprises assembly means 13, and at least one additional self-winding mechanism 100 includes complementary assembly means 113 for the positioning and secure attachment thereof to case 10. The left part of FIG. 1 illustrates an example of a screw attachment between an external thread 13A and an internal thread 113A, whereas the right part of the same Figure illustrates an example of a snap fit between two complementary lips 13B and 113B.

In a particular embodiment, case 10 comprises indexing means 12 and such assembly means 13, and at least one additional self-winding mechanism 100 includes complementary indexing means 112 and complementary assembly means 113 for the positioning and secure attachment thereof to case 10. A particular, non-limiting embodiment is of the bayonet fitting type, similar to that of a camera lens, with relative positioning by aligning complementary markings, which are indexing means 12 and complementary indexing means 112, front insertion, and rotation to a locking position on a spring ball catch or similar. FIG. 2 illustrates another snap fit example, with a lip 13 cooperating with a fir tree-shaped housing 113 comprising several parallel grooves.

One advantage of the invention is the removable and portable nature of additional self-winding mechanism 100, which makes it easier to perform operations inside case 10, to which access can easily be freed. However, it may be advantageous, especially when watch 1 comprises several additional self-winding mechanisms 100, for at least one of these additional self-winding mechanisms 100 to be fixedly attached to case 10.

In a particularly advantageous manner, additional self-winding mechanism 100 forms a sealed portable and removable unit, free of any openings. The sealing is ensured in particular by gaskets 106, 107. The portable removable unit may also be completely welded or bonded over its entire periphery, and further interventions are no longer required or even possible inside the unit.

In particular, case 10 forms a sealed unit free of any openings. Specifically, sealing means 11 connect case back 15 and case 10.

In short, the additional self-winding mechanism 100 comprised in a watch 1 according to the invention, is devised as an optional additional module, allowing a self-winding function to be moved outside watch case 10, and therefore, in variants produced based on existing watches, freeing the space usually reserved for the oscillating weight inside case 10, and using this space to house other complications or to make the product significantly thinner.

The advantage of a contactless coupling system, particularly a magnetic system, is that it removes any difficulty for the user in adding the self-winding mechanism. The operation does not risk affecting the impermeability of the watch, as there is no operation to be performed on the watch case. Magnetic coupling can be achieved with magnets attracting or repelling each other. An optional and recommended additional shield allows the magnetic circuit to be closed and leakage minimised.

The dimensions of such a magnetic coupling, with small transmitter and receiver wheels, typically with a diameter of around 10 mm, preferably including from 3 to 12 neodymium iron boron magnets, is perfectly compatible with optimum operation for the typical small accelerations occurring during normal wear. Although the magnetic coupling might become uncoupled in the event of a sharp acceleration, there is no damage, since at most, the watch will not be wound during the first high-speed turns of the oscillating weight. It is known that, in practice, an automatic wind watch is often at maximum winding during wear; a system that is less efficient than mechanical coupling can thus be tolerated. In such case, the conventional slip spring of automatic wind mainsprings can be removed, which represents an advantage.

In another variant, the coupling system between a reduction gear of the optional module and a reduction gear of the winding mechanism, or of the movement, inside the watch case is achieved by an additional self-winding mechanism, which comprises a direct mechanical coupling, by pinions, meshing or suchlike. The internal arrangement of the additional mechanism may be the same as that described above for the contactless variant, especially with an oscillating weight. Transmitter wheel set 110 is then replaced by a drive wheel set, which cooperates in a conventional mechanical drive arrangement with an input wheel set located inside the watch, and which replaces receiver wheel set 41.

The invention authorizes a very easy fitting of at least such an additional mechanism of automatic winding 100 with an accessory of the vestimentary type, it can indeed be easily integrated into an accessory such as an additional bracelet 51, or a clothing 52, in particular on the level of a pocket, or an accessory of leather goods 52, such as wallet, diary, girdles, or similar, this accessory being arranged to lock up the case 10, or to lock up a unit made up of the case 10 and a bracelet 50 fixed to the case 10.

What is claimed is:

1. A watch comprising a case containing a movement and at least one energy accumulator recharged with energy by at least one winding mechanism, wherein said watch is arranged to receive, attached to said case or to a bracelet or strap or to an external component of said watch disposed in immediate proximity to said case, at least one additional self-winding mechanism arranged to be worn by a user at the same time as said watch and comprising at least one transmitter wheel set arranged for contactless cooperation with at least one receiver wheel set comprised in a said winding mechanism, by remote interaction under the action of at least one field in the air-gap between said at least one transmitter wheel set and said at least one receiver wheel set, the intensity of said at least one field and the maximum air-gap distance being defined to transmit to said at least one receiver wheel set, to charge with energy said at least one energy accumulator, a torque or a force imparted by any movement of a user to said at least one transmitter wheel set, wherein said at least one field is magnetic or electrostatic, and wherein at least one said additional self-winding mechanism is removable and portable with respect to said case.

2. The watch according to claim 1, wherein said watch comprises at least one pair formed of a said transmitter wheel set and a said receiver wheel set wherein at least one of the two is magnetically charged, said transmitter wheel set being magnetically charged or ferromagnetic and arranged to cooperate by magnetic interaction with said magnetically charged or ferromagnetic receiver wheel set.

3. The watch according to claim 2, wherein, within said at least one pair, both said transmitter wheel set and said receiver wheel set are magnetically charged.

4. The watch according to claim 3, wherein, within said at least one pair, said transmitter wheel set and said receiver wheel set present to each other pole pieces comprising air-gap surfaces that are all substantially parallel to each other and of the same polarity.

5. The watch according to claim 3, wherein, within said at least one pair, said transmitter wheel set and said receiver wheel set present to each other pole pieces comprising air-gap surfaces that are all substantially parallel to each other and of opposite polarity.

6. The watch according to claim 2, wherein, within said at least one pair, said transmitter wheel set comprises transmittable pole pieces whose main field lines are coplanar in a transmitting plane, and said receiver wheel set comprises receiver pole pieces whose main field lines are coplanar in a receiving plane, and wherein the air-gap between said transmitter wheel set and said receiver wheel set, is a cylindrical volume delimited by said transmitting plane and said receiving plane which are parallel to each other.

7. The watch according to claim 1, wherein said additional self-winding mechanism comprises at least one oscillating weight moving under the action of the movements of the user of said watch and forming a said transmitter wheel set or forming drive means for driving the pivoting or rotation or translational motion of at least one said transmitter wheel set.

8. The watch according to claim 1, wherein said at least one transmitter wheel set comprises a transmitter path arranged to be positioned as close as possible to a said receiver wheel set.

9. The watch according to claim 1, wherein said winding mechanism comprises, downstream of a ratchet directly powering a said energy accumulator, a reduction gear train comprising, opposite said ratchet, uncoupling means downstream of which is located at least one said receiver wheel set, in direct proximity to the inner periphery of said case.

10. The watch according to claim 1, wherein said winding mechanism comprises a ratchet directly powering a said energy accumulator, and which constitutes a said receiver wheel set.

11. The watch according to claim 1, wherein said watch comprises at least one pair formed of a said transmitter wheel set and a said receiver wheel set, in which pair cooperation occurs in an axial direction with respect to a main axis of said case.

12. The watch according to claim 1, wherein said watch comprises at least one pair formed of a said transmitter wheel set and a said receiver wheel set, which are substantially annular and coaxial with respect to a main axis of said case, in which pair cooperation occurs tangentially with respect to a cylinder or a cone whose axis of revolution is parallel to or coincides with the main axis of said case, to enable winding to occur by a deliberate or unintentional action of the user.

13. The watch according to claim 1, wherein said case include a transparent back cover and wherein said additional self-winding mechanism comprises, on both sides of the set of said transmitter wheels comprised therein, at least two crystals at least one of which is arranged to be disposed as close as possible to said transparent back cover.

14. The watch according to claim 1, wherein said case comprises indexing means and assembly means, and at least one said additional self-winding mechanism includes complementary indexing means and complementary assembly means for the positioning and secure attachment thereof to said case.

15. The watch according to claim 1, wherein said additional self-winding mechanism forms a sealed portable and removable unit, free of any openings.

16. The watch according to claim 1, wherein said case forms a sealed unit, free of any openings.

17. The watch according to claim 1, wherein said watch is a mechanical watch whose said movement is mechanical, and wherein at least one said energy accumulator comprises at least one mainspring barrel.

18. The watch according to claim 1, wherein said watch is an electronic watch whose said movement is electronic or electromechanical, and wherein at least one said energy accumulator is powered by a mechanical-to-electrical energy converter.

19. The watch according to claim 1, wherein said watch is an electronic watch whose said movement is electronic or electromechanical, and wherein at least one said energy accumulator comprises at least one mainspring barrel.

20. The watch according to claim 1, wherein at least a said additional mechanism of automatic winding is integrated into an additional bracelet arranged to lock up the said case or to lock up an unit made up of said case and of a bracelet fixed to said case.

21. The watch according to claim 1, wherein at least a said additional mechanism of automatic winding is integrated into a clothing arranged to lock up the said case or to lock up a unit made up of the said case and of a bracelet fixed to said case.

22. The watch according to claim 1, wherein at least a said additional mechanism of automatic winding is integrated into an accessory of leather goods portable by an user and is arranged to lock up the said case or to lock up an unit made up of the said case and of a bracelet fixed to the said case.

* * * * *